US009574773B2

(12) United States Patent
Yoshioka

(10) Patent No.: US 9,574,773 B2
(45) Date of Patent: Feb. 21, 2017

(54) COMBUSTION CONTROL DEVICE

(71) Applicant: SHIZUOKA SEIKI CO., LTD, Shizuoka (JP)

(72) Inventor: Shogo Yoshioka, Shizuoka (JP)

(73) Assignee: SHIZUOKA SEIKI CO., LTD, Shizuoka (JP)

( * ) Notice: Subject to any disclaimer, the term of this patent is extended or adjusted under 35 U.S.C. 154(b) by 598 days.

(21) Appl. No.: 14/050,408

(22) Filed: Oct. 10, 2013

(65) Prior Publication Data

US 2014/0178826 A1 Jun. 26, 2014

(30) Foreign Application Priority Data

Oct. 12, 2012 (JP) ..... 2012-226813

(51) Int. Cl.
*F23N 5/24* (2006.01)
*F23N 3/08* (2006.01)

(52) U.S. Cl.
CPC ..... *F23N 5/242* (2013.01); *F23N 3/082* (2013.01)

(58) Field of Classification Search
CPC ..... F23N 5/242; H02P 5/68; H02P 5/74
USPC ..... 318/34, 558
See application file for complete search history.

(56) References Cited

U.S. PATENT DOCUMENTS 5,055,825 A * 10/1991 Yang ..... B60H 1/00978 165/11.1
6,255,826 B1 * 7/2001 Ohsawa ..... B60K 6/28 320/116
6,868,668 B2 * 3/2005 Suzuki ..... F02D 41/0027 123/550
8,269,460 B2 * 9/2012 Ishikawa ..... B60L 11/14 320/122

FOREIGN PATENT DOCUMENTS

JP 2008-304142 A 12/2008
JP 2014-077610 A 5/2014

* cited by examiner

*Primary Examiner* — David S Luo
(74) *Attorney, Agent, or Firm* — Miller Canfield Paddock and Stone; Mark L Maki

(57) ABSTRACT

A combustion control device includes a combustion fan motor, a control unit, a silicon diode group, a silicon diode, and a combustion-fan-disconnection detecting unit. The control unit is configured to control a combustion state of the combustion fan motor. The silicon diode group includes at least two silicon diodes coupled in series to the combustion fan motor. The silicon diode is coupled in parallel to the silicon diode group with a reversed polarity. The combustion-fan-disconnection detecting unit includes a photocoupler and a resistor. The photocoupler and the resistor are coupled in parallel to the silicon diode group and the silicon diode with the same polarity as a polarity of the silicon diode group side.

12 Claims, 4 Drawing Sheets

COMBUSTION CONTROL DEVICE

CROSS REFERENCE TO RELATED APPLICATIONS

This application is based on and claims priority under 35 U.S.C. §119 to Japanese Patent Application No. 2012-226813, filed on Oct. 12, 2012, the entire content of which is incorporated herein by reference.

FIELD OF THE INVENTION

The present invention relates to a combustion control device, especially to a combustion control device used in a wide range from 100V to 230V to ensure detection of a disconnection state of a combustion fan motor.

DESCRIPTION OF THE RELATED ART

A combustion control device is disclosed in Japanese Unexamined Patent Application Publication No. 2008-304142 (hereinafter referred to as Patent Literature 1) as follows.

The combustion control device disclosed in Patent Literature 1 includes the combustion-state determiner that determines the rotation status of the combustion fan and/or whether or not the combustion fan is out of order in response to a detection signal to achieve the object of providing a combustion control device that detects a rotating state of a combustion fan and comprehends a supplying operation of combustion air so as to accurately determine whether or not the combustion fan is out of order.

In that regard, in the conventional combustion control device, the following two measures are considered to detect a non-operating state of the combustion fan.

(1) A micromanometer such as a draft switch is provided.

(2) A rotation detecting sensor is provided to detect rotation of the combustion fan motor.

The following two measures are considered to detect that current is not flowing into the combustion fan.

(a) A current sensor (an electric current detector with a magnetic field) is provided.

(b) A shunt resistor is provided to generate a voltage drop.

However, either of measures (1) and (2) described above allows for actually detecting a non-operating state of the combustion fan, but requires the addition of an independent detector in the midstream of the circuit. A consequent drawback is that the component cost is increased.

In the respective measures (1), (2), and (a) described above, an additional drawback is that an expensive detector is required and the cost becomes larger.

Further, in measure (b) described above, the resistor disposed in the midstream of the circuit limits a range of operating voltage. This does not allow use of the circuit in a wide range from 100V to 200V. A consequent drawback is that the detection might not be possible in the case where a power-supply voltage is decreased.

An object of the present invention is to achieve a combustion control device that includes diodes coupled in a series array, is used in a wide range from 100V to 230V, and ensures detection of a disconnection state of a combustion fan motor.

SUMMARY OF THE INVENTION

To eliminate the above-described drawbacks, the present invention includes a combustion fan motor, a control unit, a silicon diode group, a silicon diode, and a combustion-fan-disconnection detecting unit. The control unit is configured to control a combustion state of the combustion fan motor. The silicon diode group includes at least two silicon diodes coupled in series to the combustion fan motor. The silicon diode is coupled in parallel to the silicon diode group with a reversed polarity. The combustion-fan-disconnection detecting unit includes a photocoupler and a resistor. The photocoupler and the resistor are coupled in parallel to the silicon diode group and the silicon diode with a same polarity as a polarity of the silicon diode group side.

With the present invention, the technical content relates to the conventional measure (b) described above, but the diodes are coupled in a series array.

The respective forward voltages of the diodes basically have the same voltage drop at the allowable current. This characteristic is effectively used. This ensures driving the photocoupler in a wide range from 100 V to 230 V.

Here, the AC load is targeted. Therefore, the diode coupled in the opposite direction is provided to eliminate the need for setting an excessively high inverse withstand voltage for all related diodes. This ensures detection of the disconnection state of the combustion fan motor.

BRIEF DESCRIPTION OF THE DRAWINGS

FIGS. 4A and 4B are schematic circuit diagrams illustrating a modification of a detecting portion, wherein FIG. 4A is a schematic circuit diagram illustrating a silicon diode group constituted of two series-coupled silicon diodes of first and second silicon diodes, and FIG. 4B is a schematic circuit diagram illustrating a silicon diode group comprising three or more series-coupled silicon diodes;

DETAILED DESCRIPTION

Figure 1:
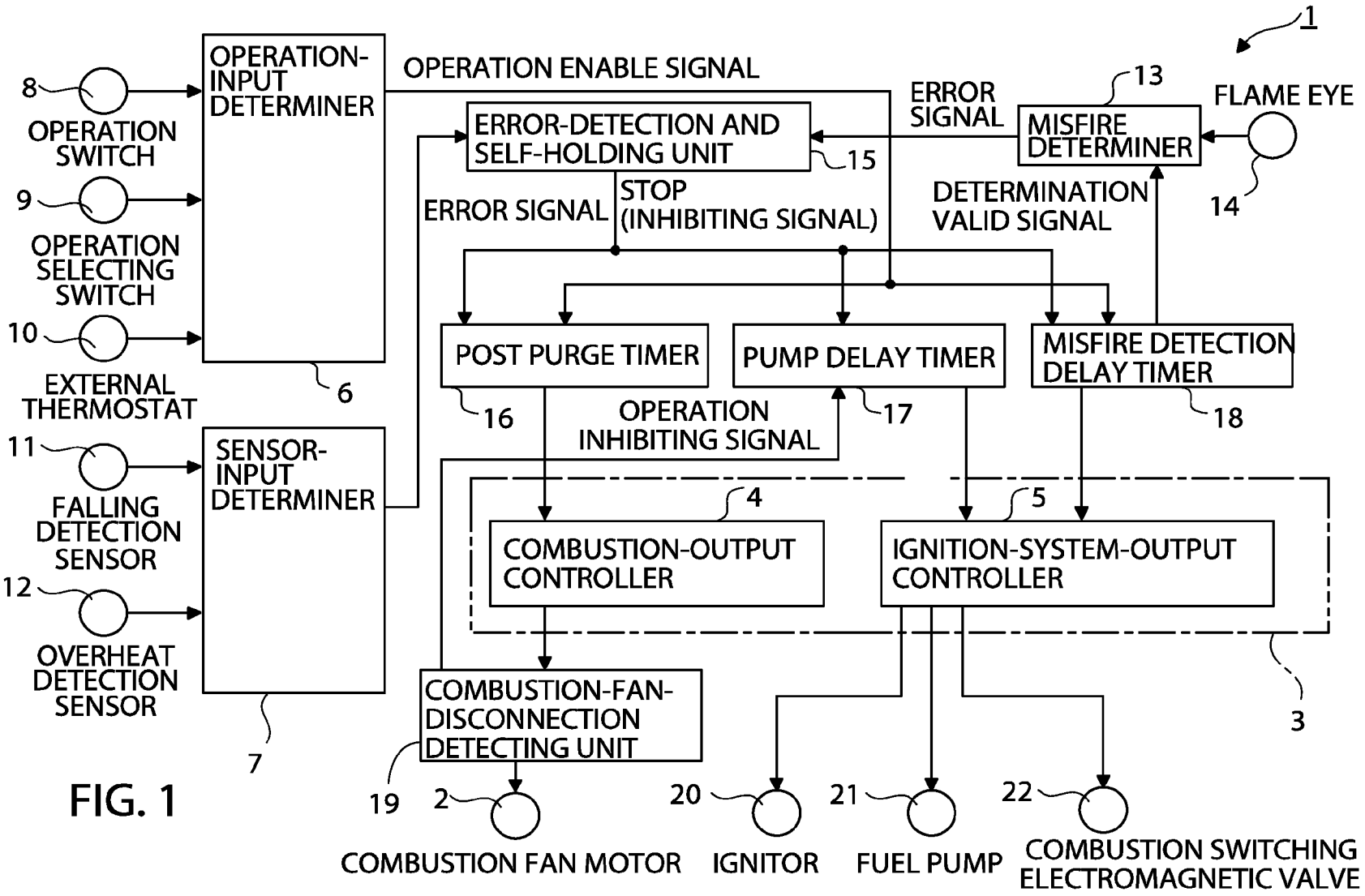
FIG. 1 is a block diagram of a combustion control device illustrating an embodiment of the present invention.

An embodiment of the present invention will be described in detail below by referring to the drawings.

Figure 2:
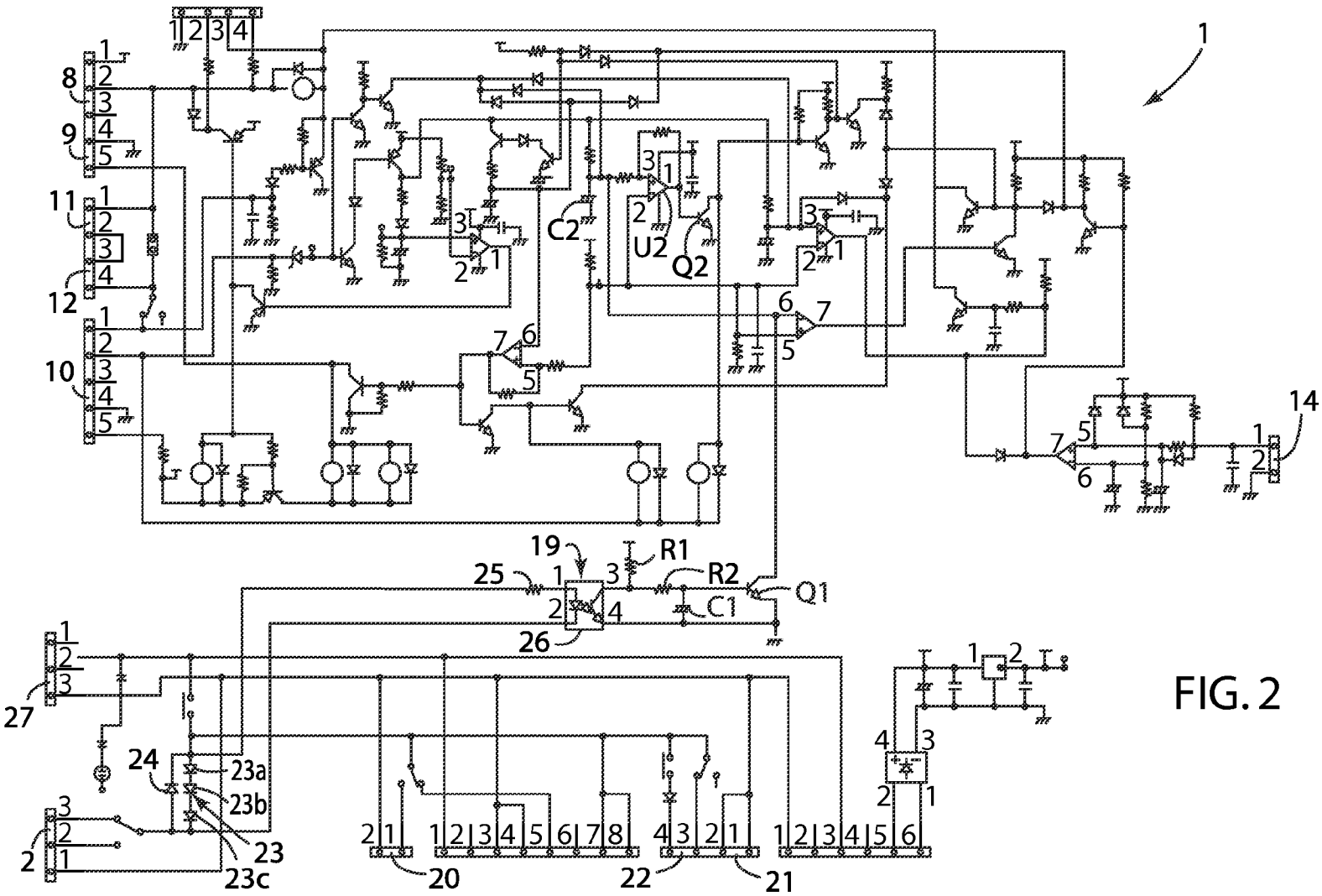
FIG. 2 is a circuit diagram of the combustion control device.
Figure 3:
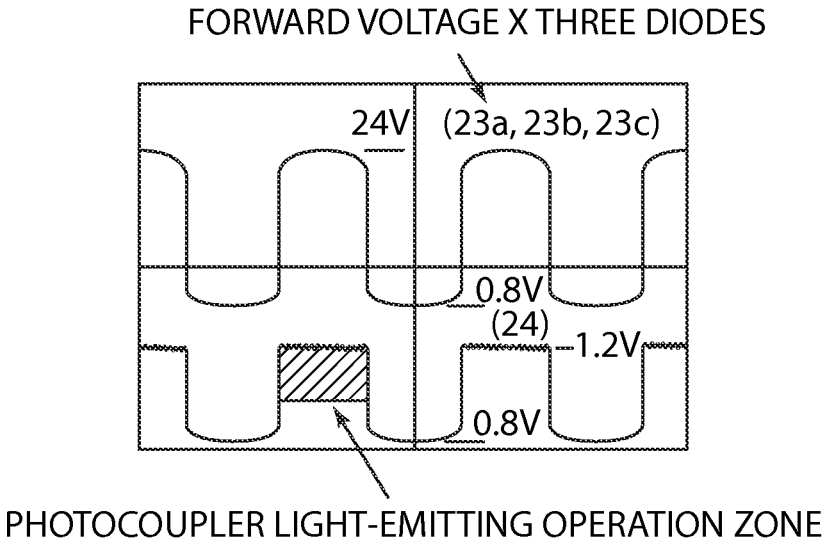
FIG. 3 is a chart illustrating load current detection data for detection by a combustion-fan-disconnection detecting unit of the combustion control device.

FIG. 1 to FIG. 3 illustrate an embodiment of the present invention.

FIG. 1 illustrates a combustion control device.

This combustion control device 1 includes a combustion fan motor 2 and a control unit 3 that controls a combustion state of the combustion fan motor 2.

Here, the control unit 3 includes a combustion-output controller 4 and an ignition-system-output controller 5. The combustion-output controller 4 controls an output state during combustion. The ignition-system-output controller 5 controls an ignition state.

In the combustion control device 1, an operation-input determiner 6, and a sensor-input determiner 7 are disposed at an input side of the control unit 3 as illustrated in FIG. 1 and FIG. 2.

Here, the operation-input determiner 6 is coupled to an operation switch 8, an operation selecting switch 9, and an external thermostat 10. The sensor-input determiner 7 is coupled to a falling detection sensor 11 and an overheat detection sensor 12.

Additionally, in the combustion control device 1, a misfire determiner 13 is disposed at the input side of the control unit 3. The misfire determiner 13 outputs an error signal based on a signal from a flame eye 14 and a determination-valid signal from a misfire detection delay timer 18 described later.

Error signals from the sensor-input determiner 7 and the misfire determiner 13 are received at an error-detection and self-holding unit 15. In response to the reception of the error signals, the error-detection and self-holding unit 15 outputs a signal (also referred to as "inhibiting signals") to a post purge timer 16, a pump delay timer 17, and the misfire detection delay timer 18.

Here, the post purge timer 16, the pump delay timer 17, and the misfire detection delay timer 18 receive an operation enable signal from the operation-input determiner 6.

The post purge timer 16 is coupled to the combustion-output controller 4 of the control unit 3 as illustrated in FIG. 1.

The pump delay timer 17 and the misfire detection delay timer 18 are coupled to the ignition-system-output controller 5 of the control unit 3.

In the combustion control device 1, a combustion-fan-disconnection detecting unit (in other words, "a combustion-fan no-load detector") 19, the combustion fan motor 2, an ignitor 20, a fuel pump 21, and a combustion switching electromagnetic valve 22 are coupled at an output side of the control unit 3.

Here, the combustion-fan-disconnection detecting unit 19 is coupled at an output side of the combustion-output controller 4 of the control unit 3. The combustion-fan-disconnection detecting unit 19 includes an output side coupled to the combustion fan motor 2 and outputs an operation inhibiting signal to the pump delay timer 17.

The ignitor 20, the fuel pump 21, and the combustion switching electromagnetic valve 22 are coupled to an output side of the ignition-system-output controller 5 in the control unit 3.

Referring to FIG. 2, the combustion control device 1 includes a silicon diode group 23, a silicon diode 24, and the combustion-fan-disconnection detecting unit 19. The silicon diode group 23 is coupled to the combustion fan motor 2 in series. The silicon diode group 23 includes at least two silicon diodes. The silicon diode 24 is coupled in parallel to the silicon diode group 23 with a reversed polarity. The combustion-fan-disconnection detecting unit 19 includes a photocoupler 26 and a resistor 25. The photocoupler 26 and the resistor 25 are coupled in parallel to the silicon diode group 23 and the silicon diode 24 with the same polarity as a polarity of the silicon diode group side.

Specifically, the combustion control device 1 includes a power supply 27 as illustrated in FIG. 2.

The silicon diode group 23 includes at least two series-coupled silicon diodes, for example, three silicon diodes of first to third silicon diodes 23*a*, 23*b*, and 23*c* as illustrated in FIG. 2.

The three silicon diodes of the first to third silicon diodes 23*a*, 23*b*, and 23*c* as the silicon diode group 23 are coupled to the silicon diode 24 with a reversed polarity in parallel.

Further, the silicon diode group 23 and the silicon diode 24 are disposed in parallel to the combustion-fan-disconnection detecting unit 19.

That is, the combustion-fan-disconnection detecting unit 19 is comprised of the resistor 25 and the photocoupler 26 that are coupled together in series. The resistor 25 and the photocoupler 26 are coupled in parallel to the silicon diode group 23 and the silicon diode 24.

The combustion control device 1 detects an operating state of the combustion fan motor 2 with the combustion-fan-disconnection detecting unit 19 in terms of the flow of load current.

In addition, first, in a primary-side circuit, the three silicon diodes of the first to third silicon diodes 23*a*, 23*b*, and 23*c* of the silicon diode group 23 generate a voltage drop at a forward voltage of about 2.4 V in a light-emitting operation zone (see a hatched portion in FIG. 3) of the photocoupler 26 as illustrated in FIG. 3, assuming that one silicon diode generates a voltage drop of about 0.8 V for example.

The generated voltage of about 2.4 V drives the photocoupler 26 to transmit a signal to a secondary-side circuit.

At an output side of the photocoupler 26, the secondary-side circuit includes a charge/discharge circuit constituted of a resistor R1, a resistor R2, and a capacitor C1 and a transistor Q1 at an output side.

When the voltage drop of about 2.4 V is generated at the primary-side circuit, the capacitor C1 is discharged. On the other hand, when the voltage drop of about 2.4 V is not generated at the primary-side circuit, the capacitor C1 is charged.

Accordingly, when the voltage drop of about 2.4 V is generated at the primary-side circuit, that is, in the light-emitting operation zone of the photocoupler 26 that is the hatched portion in FIG. 3, the transistor Q1 becomes an OFF state through the charge/discharge circuit.

In contrast, when the voltage drop of about 2.4 V is not generated at the primary-side circuit, that is, in a zone other than the light-emitting operation zone of the photocoupler 26 that is the hatched portion in FIG. 3, the transistor Q1 becomes an ON state through the charge/discharge circuit.

The transistor Q1 in the ON state does not allow charging of a capacitor C2 because of the operating state of the pump delay timer (also described as "Pump Run Delay Timer") 17.

In the case where the capacitor C2 is not charged, an op-amp U2 does not invert the input. Then, a transistor Q2 is not turned ON. Accordingly, a driving relay L1 of the fuel pump 21 does not operate.

Here, as reference, the current-conduction detection for the combustion fan motor 2 will be described.

First, the three silicon diodes of the first to third silicon diodes 23*a*, 23*b*, and 23*c* forming the silicon diode group 23 and the silicon diode 24 are each set to have a voltage drop of about 0.8 V, and the entire silicon diode group 23 is set to have a voltage drop of about 2.4 V.

The photocoupler 26 is set to have a voltage drop of about 1.2 V.

The capacitor C1 is set to have 22 μF, and the transistor Q1 is set to have a drive capability equal to or more than 13 mA.

Regarding the primary-side circuit, in the case where the photocoupler 26 is driven with a voltage at about 2.4 V generated in the light-emitting operation zone of the photocoupler 26 disclosed in the hatched portion of FIG. 3, the following equation is satisfied.

$$(2.4-1.2)/150=8 \text{ mA } (I_F)$$

Here, a loss at the resistor R1 satisfies the following equation.

$$8\ mA^2 \times 150/2 = 4.8\ mW.$$

Regarding the secondary-side circuit, in the case where a conversion efficiency of the photocoupler 26 is set to 50%, the current becomes about 4 mA.

Here, Ic at the photocoupler 26 becomes as follows.

$$Ic = 18/33\ k \approx 0.55\ mA.$$

Thus, this value of about 0.55 mA is significantly smaller than the above set value of 4 mA.

A charge τ of the capacitor C1 becomes as follows.

$$\tau = 33\ k \times 22\ \mu F = 726\ ms$$

This value of 726 ms is a multiplication of a half cycle of the power supply by 72.

Further, in the drive of the transistor Q1, a resistor RB is equivalent to the following value.

$$RB = 10\ k\Omega$$

A DC current amplification factor $h_{FE}$ is equivalent to the following value.

$$h_{FE} = 50$$

The input ON voltage R becomes as follows.

$$R = 1.2\ V$$

When the photocoupler 26 is turned OFF, the following equation is satisfied.

$$(10\ k\Omega \times 12\ V)/(33\ k\Omega + 10\ k\Omega) = 2.8\ V$$

$$12\ V/(33\ k\Omega + 10\ k\Omega) \times 50\ h_{FE} = 13\ mA$$

This 13 mA is the load current Ic.

Further, a discharge speed of the capacitor C1 is changed from 1 k to 330Ω.

As described above, the combustion control device 1 includes the silicon diode group 23, the silicon diode 24, and the combustion-fan-disconnection detecting unit 19. The silicon diode group 23 is coupled to the combustion fan motor 2 in series. The silicon diode group 23 includes at least two silicon diodes. The silicon diode 24 is coupled in parallel to the silicon diode group 23 with a reversed polarity. The combustion-fan-disconnection detecting unit 19 includes the photocoupler 26 and the resistor 25. The photocoupler 26 and the resistor 25 are coupled in parallel to the silicon diode group 23 and the silicon diode 24 with the same polarity as a polarity of the silicon diode group side.

Here, the diodes are coupled in a series array. The respective forward voltages of the diodes basically have the same voltage drop at the allowable current. This characteristic is effectively used.

This generates a voltage equal to or more than 1.6 V in a wide range from 100 V to 230 V so as to ensure driving of the photocoupler 26 that transmits a signal to the secondary-side circuit.

Here, the AC load is targeted. Therefore, the silicon diode 24 coupled in the opposite direction is disposed to eliminate the need for setting excessively high inverse withstand voltage for all related diodes. This ensures detection of the disconnection state of the combustion fan motor 2.

Further, when the combustion-fan-disconnection detecting unit 19 is added, the combustion-fan-disconnection detecting unit 19 is comprised of the resistor 25 and the photocoupler 26 that are each coupled to the silicon diode 24 in parallel. This prevents unnecessary complications in the configuration to facilitate production, and maintains low cost.

In the embodiment of the present invention, the silicon diode group 23 and the silicon diode 24 with the reversed polarity allow stopping of the fuel pump 21 while maintaining the current conduction operation to the combustion fan motor 2 during a short circuit as a representative example of semiconductor failure modes.

The present invention is not limited to the above-described embodiment. Various modifications of the application are possible.

Figure 4A:
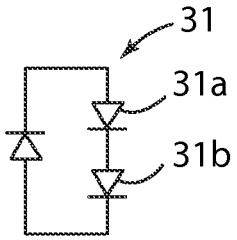

For example, while in the embodiment of the present invention the silicon diode group 23 is comprised of the three series-coupled silicon diodes of the first to third silicon diodes 23*a*, 23*b*, and 23*c*, a special configuration is possible. In this special configuration, a silicon diode group 31 includes two silicon diodes of first and second silicon diodes 32*a* and 32*b* as illustrated in FIG. 4A.

The silicon diode group 31 including the two silicon diodes of the first and second silicon diodes 32*a* and 32*b* contributes to ensuring detection of the disconnection state of the combustion fan motor, preventing unnecessary complications of the configuration to facilitate production, and maintaining low cost for example.

Figure 4B:
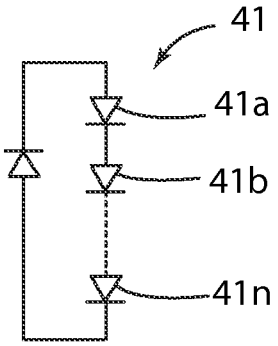

As illustrated in FIG. 4B, a special configuration is possible. In this special configuration, a silicon diode group 41 includes three or more silicon diodes of first to n-th silicon diodes 42*a*, 42*b*, . . . , 41*n*.

Accordingly, the silicon diode group 41 including the three or more silicon diodes of the first to n-th silicon diodes 42*a*, 42*b*, . . . , 41*n* contributes to ensuring detection of the disconnection state of the combustion fan motor, preventing unnecessary complications of the configuration to facilitate production, and maintaining low cost for example.

While in the embodiment of the present invention, the silicon diode group 23 is constituted of the three series-coupled silicon diodes of the first to third silicon diodes 23*a*, 23*b*, and 23*c*, that is, the first to third silicon diodes 23*a*, 23*b*, and 23*c* arranged in one row, a special configuration of the silicon diode group 51 is possible. In this special configuration, two or more rows of two or more series-coupled silicon diodes are disposed.

Figure 5:
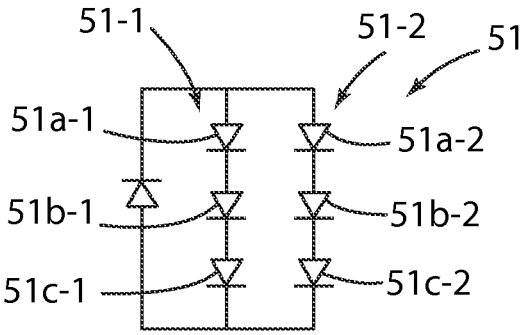
FIG. 5 is a schematic circuit diagram illustrating a first modification of a parallel circuit section.

That is, for example, as illustrated in FIG. 5, two rows of three series-coupled silicon diodes comprised of first to third silicon diodes are provided. That is, a first-row silicon diode group 51-1 in a first row and a second-row silicon diode group 51-2 in a second row are provided.

The first-row silicon diode group 51-1 includes three series-coupled silicon diodes comprised of first to third silicon diodes 51*a*-1, 51*b*-1, and 51*c*-1. On the other hand, the second-row silicon diode group 51-2 includes three series-coupled silicon diodes comprised of first to third silicon diodes 51*a*-2, 51*b*-2, and 51*c*-2.

Accordingly, the silicon diode group 51 including the two or more rows of the two or more series-coupled silicon diodes contributes to ensuring detection of the disconnection state of the combustion fan motor, preventing unnecessary complications of the configuration to facilitate production, and maintaining low cost for example.

Additionally, the first-row silicon diode group 51-1 in the first row and the second-row silicon diode group 51-2 in the second row shunt the conducting current. This allows the arrangement of a plurality of low-capacity diodes, and ensures a small and low-price parts structure.

Further, when the silicon diode group is formed by providing two or more rows of two or more series-coupled silicon diodes, a special configuration is possible. In this special configuration, midstream portions in the respective rows are coupled together.

Figure 6:
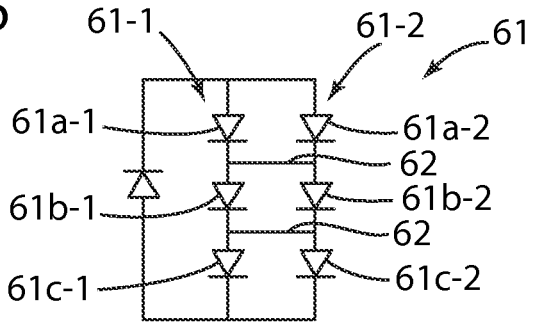
FIG. 6 is a schematic circuit diagram illustrating a second modification of the parallel circuit section.

That is, similar to FIG. 5 above, as illustrated in FIG. 6, two or more rows of, for example, two rows of a first-row silicon diode group 61-1 in a first row and a second-row silicon diode group 61-2 in a second row are disposed.

The first-row silicon diode group 61-1 includes two or more, for example, three series-coupled silicon diodes of first to third silicon diodes 61*a*-1, 61*b*-1, and 61*c*-1. On the other hand, the second-row silicon diode group 61-2 includes two or more, for example, three series-coupled silicon diodes of first to third silicon diodes 61*a*-2, 61*b*-2, and 61*c*-2.

Here, respective midstream portions of the first-row silicon diode group 61-1 in the first row and the second-row silicon diode group 61-2 in the second row are coupled together with coupling lines 62 so as to comprise the silicon diode group 61.

Accordingly, the silicon diode group 61 where the respective midstream portions of the first-row silicon diode group 61-1 in the first row and the second-row silicon diode group 61-2 in the second row are coupled together with the coupling lines 62 contributes to ensuring detection of the disconnection state of the combustion fan motor, preventing unnecessary complications of the configuration to facilitate production, and maintaining low cost for example.

Additionally, the respective midstream portions of the first-row silicon diode group 61-1 in the first row and the second-row silicon diode group 61-2 in the second row are coupled together with the coupling lines 62 so as to comprise the silicon diode group 61. This allows an arrangement of a plurality of low-capacity diodes, and ensures a small and low-price parts structure, similar to FIG. 5 above.

Further, while in the embodiment of the present invention the silicon diode group 23 includes the three series-coupled silicon diodes of the first to third silicon diodes 23*a*, 23*b*, and 23*c*, a special configuration is possible. In this special configuration, a silicon diode group 71 includes at least one series-coupled resistor 72.

Figure 7:
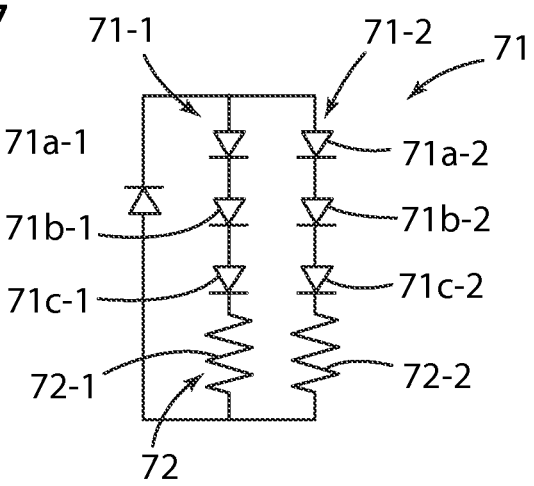
FIG. 7 is a schematic circuit diagram illustrating a third modification of the parallel circuit section.
Figure 8:
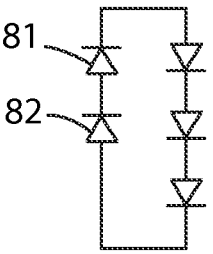
FIG. 8 is a schematic circuit diagram illustrating a modification of a silicon diode section comprised of a plurality of silicon diodes, for example, two series-coupled silicon diodes comprised of first and second silicon diodes.

That is, similar to FIG. 5 above, as illustrated in FIG. 7, two or more rows of, for example, two rows of a first-row silicon diode group 71-1 in a first row and a second-row silicon diode group 71-2 in a second row are provided.

The first-row silicon diode group 71-1 includes two or more, for example, three series-coupled silicon diodes of first to third silicon diodes 71*a*-1, 71*b*-1, and 71*c*-1. On the other hand, the second-row silicon diode group 71-2 includes two or more, for example, three series-coupled silicon diodes of first to third silicon diodes 71*a*-2, 71*b*-2, and 71*c*-2.

Here, at least one resistor, for example, one first resistor 72-1 is coupled in series to the first-row silicon diode group 71-1 in the first row and at least one resistor, for example, one second resistor 72-2 is coupled in series to the second-row silicon diode group 71-2 in the second row, so as to comprise the silicon diode group 71.

Accordingly, the silicon diode group 71 including at least one series-coupled resistor 72 contributes to ensuring detection of the disconnection state of the combustion fan motor, preventing unnecessary complications of the configuration to facilitate production, and maintaining low cost for example.

Additionally, the first-row silicon diode group 71-1 and the second-row silicon diode group 71-2 are coupled together to provide an effect to balance branch currents through the first-row silicon diode group 71-1 and the second-row silicon diode group 71-2, thus improving operation stability (in other words, "reliability") of the circuit.

While in the embodiment of the present invention the reversed polarity section is comprised of one silicon diode 24, a special configuration is possible. In this special configuration, a plurality of, for example, two silicon diodes of first and second silicon diodes 81 and 82 are coupled together in series so as to comprise the reversed polarity section in a group configuration.

Accordingly, for example, disposing the two silicon diodes of the first and second silicon diodes 81 and 82 at the reversed polarity side contributes to ensuring detection of the disconnection state of the combustion fan motor, preventing unnecessary complications of the configuration to facilitate production, and maintaining low cost for example.

Further, three or more silicon diodes may be coupled together in series at the reversed polarity side.

In the above-described configuration of the silicon diodes at the reversed polarity side, a special configuration is possible. In this special configuration, a plurality of silicon diodes are coupled not only in series but also in parallel. This provides the similar effect as described above.

What is claimed:

1. A combustion control device, comprising:

a power supply for supplying AC power to said combustion control device:

a combustion fan motor connected to said power supply so as to operate by AC power;

a control unit configured to control a combustion state of the combustion fan motor;

a silicon diode group that includes at least two first silicon diodes coupled in series to the combustion fan motor and said power supply, said first silicon diodes having a first polarity permitting a current flow from said power supply to said combustion fan motor for operation of said combustion fan motor;

at least one second silicon diode coupled in parallel with the silicon diode group between said power supply and said combustion fan motor, said silicon diode having a reversed second polarity that is reversed relative to said first polarity of said first silicon diodes; and a combustion-fan-disconnection detecting unit that is coupled to said control unit and includes a photocoupler and a resistor, the photocoupler and the resistor being coupled in parallel to the silicon diode group and the second silicon diode with a same polarity as said first polarity of the silicon diode group side.

2. The combustion control device according to claim 1, wherein the silicon diode group includes two or more rows of two or more of said first silicon diodes wherein said first silicon diodes of each said row are series-coupled together in said row.

3. The combustion control device according to claim 1, wherein the silicon diode group includes at least one resistor which is series coupled with a plurality of said first silicon diodes.

4. The combustion control device according to claim 1, wherein said combustion-fan-disconnection detecting unit detects an operating sate of said combustion fan motor relative to a flow of load current between said power supply and said combustion fan motor.

5. The combustion control device according to claim 1, wherein said first silicon diodes of said silicon diode group generate a voltage drop during a forward voltage which defines a generated voltage which operates said photocoupler.

6. The combustion control device according to claim 1, wherein said operation of said photocoupler in the presence of said generated voltage generates a signal to said control unit, and an absence of said generated voltage does not generate said signal.

7. A combustion control device, comprising:

a power supply for supplying AC power to said combustion control device:

a combustion fan motor operable by AC power received from said power supply;

a control unit configured to control a combustion state of the combustion fan motor;

a silicon diode group that includes at least two first silicon diodes coupled in series between and with said combustion fan motor and said power supply, said first silicon diodes having a first polarity permitting a current flow from said power supply to said combustion fan motor for operation of said combustion fan motor by a load current of AC power supplied by said power supply;

at least one second silicon diode coupled in parallel with the silicon diode group between said power supply and said combustion fan motor, said silicon diode having a reversed second polarity that is reversed relative to said first polarity of said first silicon diodes; and a combustion-fan-disconnection detecting unit that is coupled to said control unit and includes a photocoupler and a resistor, which are coupled together in series and together are coupled in parallel with said silicon diode group and in parallel with said second silicon diode, said combustion-fan-disconnection detecting unit having a same polarity as said first polarity of said first silicon diodes of said silicon diode group side;

said first silicon diodes of said silicon diode group being set to generate a voltage drop during a forward voltage which defines a generated voltage which operates said photocoupler.

8. The combustion control device according to claim 7, wherein said operation of said photocoupler in the presence of said generated voltage generates a signal to said control unit, and an absence of said generated voltage does not generate said signal.

9. The combustion control device according to claim 7, wherein said combustion-fan-disconnection detecting unit detects an operating sate of said combustion fan motor relative to a flow of said load current between said power supply and said combustion fan motor.

10. The combustion control device according to claim 7, wherein the silicon diode group includes two or more rows of two or more of said first silicon diodes wherein said first silicon diodes of each said row are series-coupled together in said row.

11. The combustion control device according to claim 7, wherein said silicon diode group includes at least one series-coupled resistor which is series-coupled with a plurality of said first silicon diodes.

12. The combustion control device according to claim 7, wherein said first silicon diodes define said generated voltage at a same level when said first silicon diodes receive said AC power over a range of supply voltages.

* * * * *